US005307547A

United States Patent [19]

Graf

[11] Patent Number: 5,307,547

[45] Date of Patent: * May 3, 1994

[54] PROCESS AND DEVICE FOR HYDRODYNAMIC DRAWING OF A POLYMER THREAD

[75] Inventor: Felix Graf, Winterthur, Switzerland

[73] Assignee: Rieter Machine Works, Ltd., Winterthur, Switzerland

[ * ] Notice: The portion of the term of this patent subsequent to Sep. 10, 2008 has been disclaimed.

[21] Appl. No.: 735,833

[22] Filed: Jul. 25, 1991

[30] Foreign Application Priority Data

Jul. 27, 1990 [CH] Switzerland ..... 02499/90

[51] Int. Cl.[5] ..... D01D 5/14

[52] U.S. Cl. ..... 28/246; 28/240

[58] Field of Search ..... 28/240, 246; 264/181, 264/290.5

[56] References Cited

U.S. PATENT DOCUMENTS

| | | | |
|---|---|---|---|
| 3,002,804 | 10/1961 | Kilian | 28/240 X |
| 3,068,062 | 12/1962 | Morgan, Jr. | 28/246 X |
| 3,077,004 | 2/1963 | Mummery | 28/240 X |
| 3,124,631 | 3/1964 | Davis et al. | 28/240 X |
| 3,379,811 | 4/1968 | Hartmann et al. | 264/290.5 X |
| 3,497,910 | 3/1970 | Maeda et al. | 28/246 |
| 4,059,668 | 11/1977 | Bittle et al. | 264/181 X |
| 4,863,662 | 9/1989 | Hasegawa et al. | 264/557 X |
| 5,046,225 | 9/1991 | Graf | 28/240 X |

FOREIGN PATENT DOCUMENTS

| | | | |
|---|---|---|---|
| 0176937 | 4/1986 | European Pat. Off. | |
| 1435704 | 3/1969 | Fed. Rep. of Germany | |
| 1-246437 | 10/1989 | Japan | 28/240 |

*Primary Examiner*—Clifford D. Crowder
*Assistant Examiner*—Bibhu Mohanty
*Attorney, Agent, or Firm*—Francis C. Hand

[57] ABSTRACT

Threads consisting of one or more filaments are drawn by being pulled through a braking fluid. Threads consisting of a plurality of filaments are formed into a ribbon for the drawing process. Inside the drawing bath, the thread is heated to a temperature corresponding to its second order transition temperature and is braked in such a way that its tension reaches the tension necessary for drawing the filament or the filaments. Through setting and/or controlling the length of the thread path inside the braking fluid, the viscosity of the fluid, additional mechanical braking means and/or the flow characteristics in the bath, the process is made adaptable for different thread materials and different thread speeds and can be optimized for thread quality. The device for carrying out the process has a quasi-closed main chamber through which a braking fluid is circulated. An antechamber with a variable fluid level may be arranged in front of the entrance to the main chamber. The chambers are formed by two parts that can be folded apart to facilitate threading up.

21 Claims, 5 Drawing Sheets

PROCESS AND DEVICE FOR HYDRODYNAMIC DRAWING OF A POLYMER THREAD

This invention relates to a drawing bath. More particularly, this invention relates to a process and device for hydrodynamic drawing of synthetic filaments.

In the production of synthetic filaments or more precisely linear polymeric filaments (smooth yarns), the filaments must be drawn shortly after extrusion, in order to obtain an orientation of the molecules along the fiber axis only as a result of this drawing process does the synthetic yarn reach usable values for ductile yield and strength. The drawing elongation for orienting the polymers is considerable and is generally a multiple of their original length. The prior art discloses that drawing elongation must take place in a small, defined drawing zone, in order to obtain uniform filament characteristics over the entire length (U.S. Pat. 2 289 232 dated 1942). This opinion is still widely held, although doubts were expressed about it some 20 years later (U.S. Pat. No. 3 002 804 dated 1961) and it was opposed by a method for a non-mechanical drawing process. This non-mechanical drawing process was only successful at high thread speeds which were not obtainable at that time. However, despite the increasing thread speeds, now up to 6000 meters per minute, the drawing processes are still effected mechanically at a cost and effort which is not inconsiderable. The moving away from the constraint of "drawing zones as small as possible" permitted the introduction of the idea of a hydraulic or liquid brake between the spinning nozzle and the winding machine in which, naturally, the filament cannot be drawn off as "sharply", but instead very uniformly, compared with a mechanical braking arrangement. However, limits were set to this early idea (1961), which, up until today, have not permitted an industrial use. Thus, the process described in U.S. Pat. No. 3 002 804 has remained a laboratory process and has not been used in the actual manufacture of synthetic yarns. This is still the case, as indicated by German Patent No. 35 34 079, according to which industrial use of such a process was prevented by significant disadvantages. It has also been found that a short drawing zone is achieved also when the braking process is carried out in a liquid medium.

As indicated in FIG. 5 of U.S. Pat. No. 3 002 804, high thread speeds require smaller passage lengths in the chamber, which is desirable in itself, however it becomes apparent only at yarn speeds as from about 5000 meters per minute and only increases slightly at higher speeds. Thus, the process could offer advantages from the point of view of its dynamics. However, in view of the requirements of modern high speed yarn production, prospects for an adequate liquid bath braking process have not been good. Too many questions are still open today, e.g. the flow conditions in the chamber at high filament speeds. The method suffers from too many technical inadequacies, e.g. the passing of the filaments through small openings, which must be neither too large, nor too small, so that it cannot be put into practical effect on the basis of existing knowledge. The fact that the higher the speed of passage the smaller the braking zones (passage distances) is counteracted by the experience that higher thread speeds make the technical manipulation and the parallel-guided multithread drawing process disproportionately more difficult.

The use of a brake bath is considered so disadvantageous in German Patent No. 35 34 079, that drawing by means of a drawing pin is retained and an attempt is made to solve the problem with liquid friction against such a type of pin. The described process is an attempt to solve the problem of adequate water application to the thread. This wetting problem is solved in that the stretched thread bundle with the parallel filaments is passed through a liquid film, which is applied in dosed form to cylindrical brake surfaces. The cylindrical surfaces, preferably have a thread groove and the capillary force between the filament bundle and the braking surface further assists the wetting process. The liquid must not be hydroextracted or torn away from the cylindrical surface to collect in thread areas remote from the brake surface. However, there is a considerable risk of the liquid film still tearing and of the thread running dry unnoticed. In this case, hydrodynamic friction then passes into undesired mechanical friction. A temperature control in a thin liquid film is also very difficult. Thus, it must be expected that drawing takes place below the second order transition point (at a brittle temperature). Thus, brittle fractures can occur. This process overall appears to be technically problematical.

Despite all the existing prejudices, it is an object of the invention to use the liquid bath process for the drawing of synthetic filaments and to put the process into practical realization much as described by the aforementioned U.S. Patent. The earlier European Application No. 90810061.3 (publication No. 0384886) describes such a process and means to carry out the process.

It is the object of the present invention to further develop the aforementioned process and the corresponding devices in such a manner that for production of various yarn qualities, for processing at varying thread speeds and for application in connection with various production processes, they can be adjusted both over a wide range and in the sense of fine tuning so that the drawing process can, in each case, provide an optimal product.

Briefly, the invention provides a process and device for hydrodynamic drawing of a polymer thread.

In accordance with the process, a bath of heated liquid is formed and a polymer thread is moved under tension through the bath in heat exchange with the heated liquid so that the thread is heated to a temperature of the second order transition point of the thread while, at the same time, being braked to increase the tension in the thread to a drawing tension sufficient to effect drawing of the thread while in the bath.

In accordance with the process, the liquid bath may also be flowable so as to flow in either a concurrent or a counter-current direction relative to the thread. Further, the liquid bath may be maintained at a temperature in the region of the second order transition point of the thread.

In accordance with the process, the braking effect can be set or regulated for drawing of a given thread at a given processing speed by setting at least one of various parameters, such as the length of thread subjected to the braking medium; at least one of the direction of flow, quantity rate of flow and speed of flow of the liquid in the bath; the use of auxiliary mechanical braking means; the viscosity of the braking medium; generating vortices in the flow of the braking medium; and spacing stationary elements about the thread path which would have an influence on the hydrodynamics of the flow of liquid.

The device is constructed to include a delivery means for delivering at least one polymer thread; means for generating a tensile force in the thread; and a drawing means between the delivery mean and tensile force generating means. In accordance with the invention, the drawing means includes a base portion and a cover portion to define a chamber for passage of the thread therethrough on a predetermined path and for receiving a bath of liquid therein for braking of the thread passing therethrough. In addition, adjustable means are provided for adjusting the braking of the thread passing through the chamber.

In one embodiment, the drawing means includes at least one separating wall in the chamber which is parallel to the thread path in order to divide the chamber into a thread passage and at least one outer passage. In this embodiment, the adjusting means for adjusting the braking of the thread may be connected to the wall to move the wall relative to the thread path in order to adjust the spacing therebetween. This embodiment may also have a plurality of diverting elements on the wall facing the thread path in order to divert a thread passing thereover. Alternatively, the embodiment may include a throttle in the outer passage for throttling a flow of fluid passing therethrough.

In still another embodiment, the drawing means includes an antechamber between the base portion and cover portion for passage of the thread therethrough prior to passage into the main chamber. In this respect a plurality of guiding elements can be provided in the antechamber for ordering a plurality of filaments of a multifilament thread into a ribbon. In addition, an exhaust duct may communicate with the antechamber to exhaust liquid therefrom with the duct being disposed above the guiding elements in order to permit immersion of the guiding elements in the liquid. An infeed duct may also be connected to the antechamber with a means of circulating a braking medium through the ducts and antechamber. Still further, a means may be provided for adjusting the level of braking liquid in the antechamber.

These and other objects and advantages of the invention will become more apparent from the following detailed description taken in conjunction with the following drawing, wherein:

FIGS. 1 (*a* to *d*) graphically represent the approximate behavior of a filament being pulled through a drawing bath in accordance with the invention;

Figure 6:
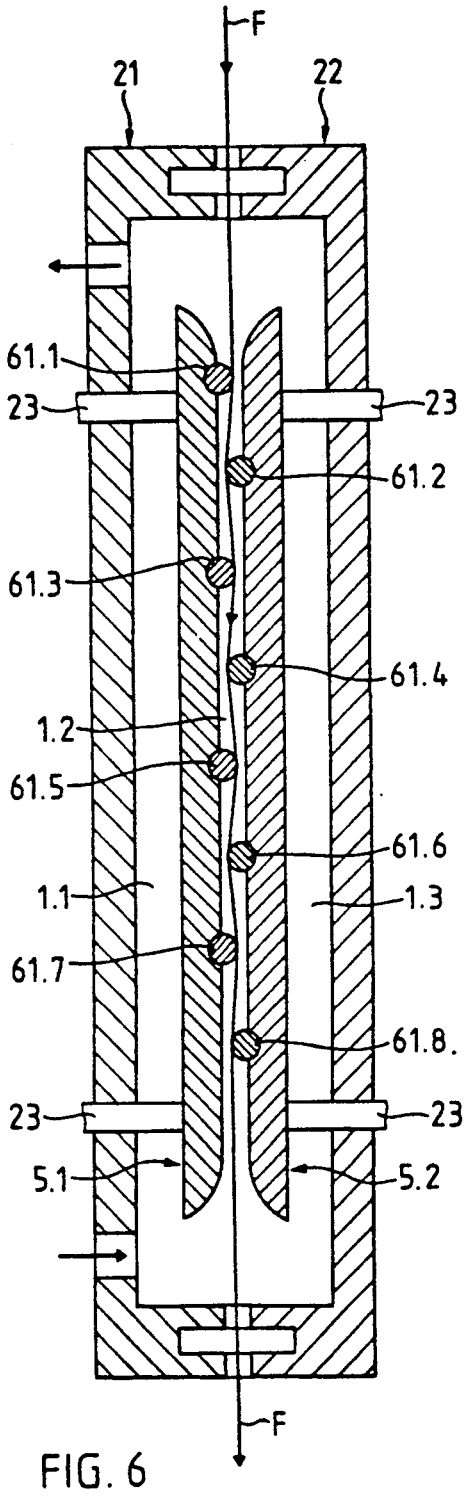
Figure 7:
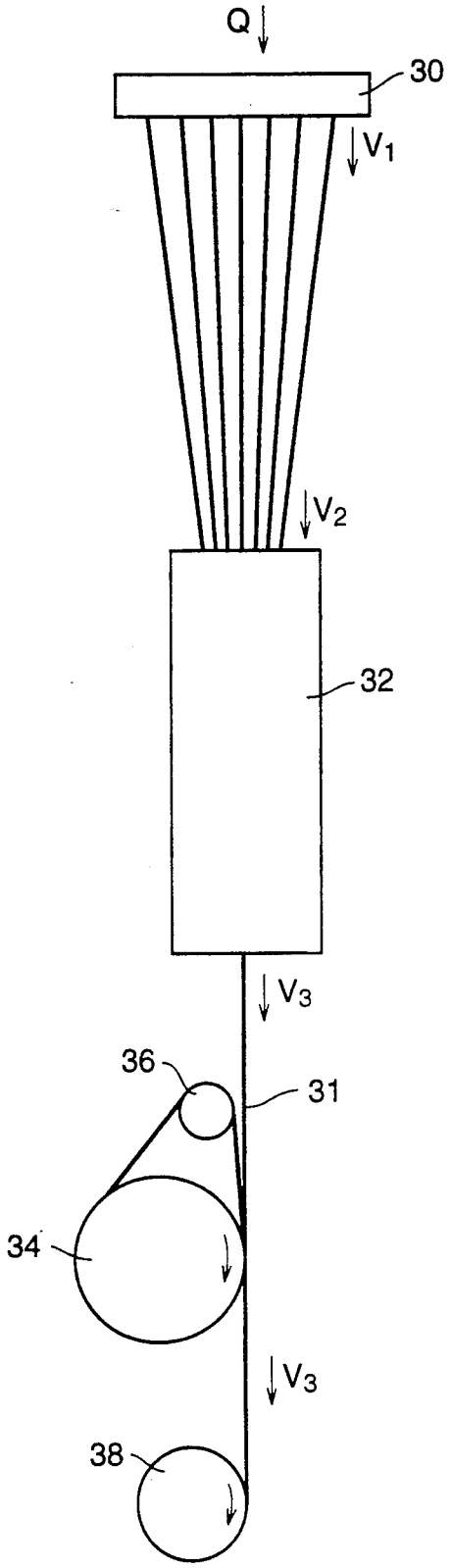

FIG. 6 shows a longitudinally sectioned chamber with two wall elements extending parallel to the threadline, the spacing of the wall elements relative to the thread being adjustable from outside the drawing chamber; and FIG. 7 shows diagrammatically the setting of a device in accordance with the invention in the context of a complete threadline operating in accordance with a so-called spin-draw-winding process.

Figure 1A:
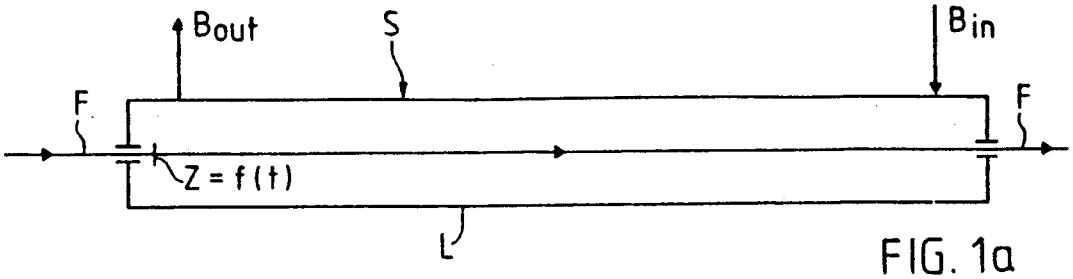

FIGS. 1*a* to 1*d* show the temperature and mechanical tension behavior of a moving filament in a liquid bath as a function of the length of the drawing bath. FIG. 1*a* schematically shows a drawing bath device S of length L, through which a filament F passes from left to right. Near to the inlet of the drawing bath, there is a small zone on the filament indicated as $Z=f(t)$, from which zone, the temperature pattern is considered during the passage through the drawing bath. The drawing bath medium is continuously circulated, in this case from $B_{in}$ to $B_{out}$, i.e. in counterflow. Naturally, the drawing bath can also be operated in a co-current manner.

Figure 1B:
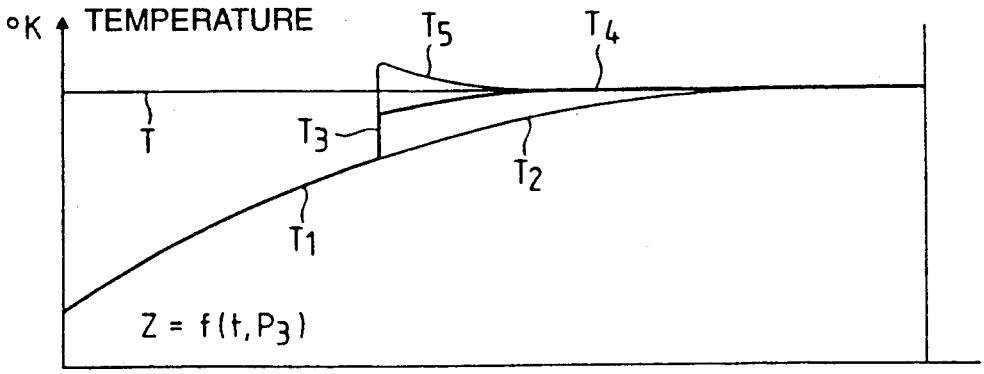

FIG. 1*b* shows the temperature pattern of the small defined zone Z on its passage through the drawing bath, with Tx designating different temperature sections relative to the length of the drawing bath. The temperature pattern is largely dependent on the passage speed and the drawing or thread tension.

Figure 1C:
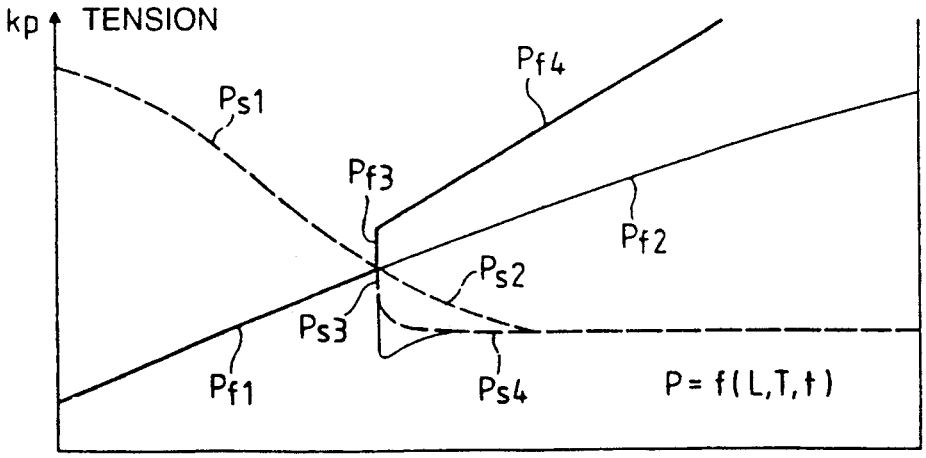

FIG. 1*c* shows tension behavior P in two ways: the drawing tension $P_s$ (tension necessary for drawing the thread) and the actual tension of the thread $P_f$. Different sections of tension are shown as $P_{sx}$ or $P_{fy}$.

Figure 1D:
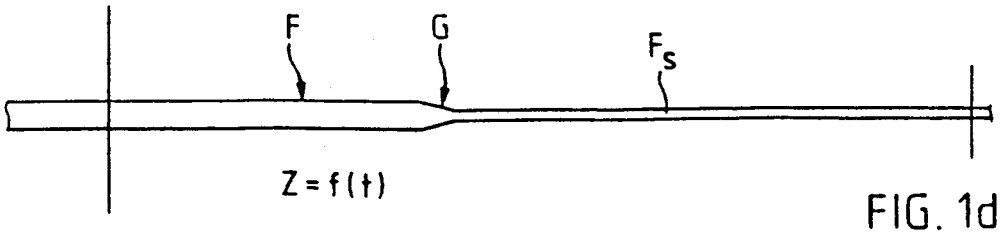

Finally, FIG. 1*d* shows the geometrical change in the defined filament zone Z on its path through the drawing bath, namely before and after a relatively well definable range G, the so called drawing point, where its area is reduced. It is advisable, to arrange the process in such a way, that the area of the filament is reduced when it has a temperature in the range of its second order transition point, where the drawing tension $P_s$ decreases sharply with increasing temperature. Below this temperature, the filament is brittle (brittle fractures), while above this temperature, the attainable orientation inside the filament decreases and with it filament strength decreases. Therefore, the ideal chamber temperature is the second order transition temperature.

The drawing operation according to FIGS. 1*a* to 1*d* runs approximately in the following way. Prior to entering the drawing bath, the filament, or fibril, has a low temperature (i.e. the quenching temperature which is of at least 50° lower than the melting point and preferably below the second order transition point). After entry into the drawing bath, the filament heats relatively quickly up to the temperature of the drawing bath (roughly in the first half of the bath). With increasing temperature, the necessary drawing tension for drawing the polymer decreases in roughly the same degree, as the temperature in the filament rises due to heating in the drawing bath. This is particularly marked in the vicinity of the second order transition point.

Figure 2:
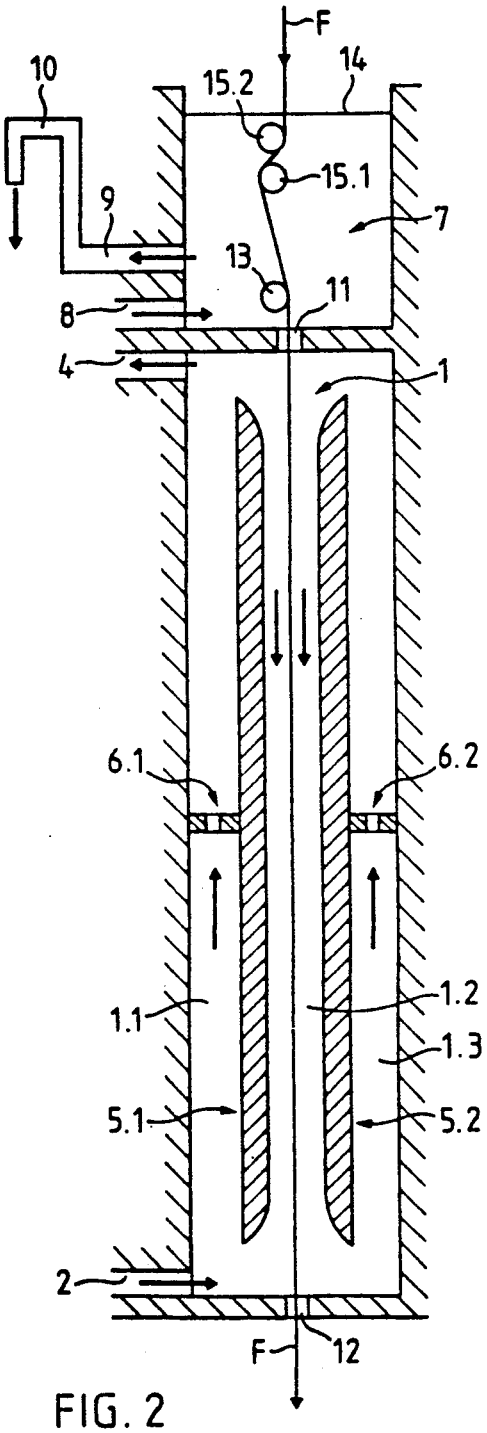
FIG. 2 shows a schematically illustrated embodiment of a drawing arrangement according to the invention for explanation of the drawing process.

The thread tension ($P_f$) would constantly rise in the drawing bath as indicated by the line $P_{f2}$ if a drawing operation did not take place. At the graphic intersection of the two inversely proportional functions of drawing tension ($P_s$) and thread tension ($P_f$), there is a spontaneous drawing ($P_{f3}$, $P_{s3}$). This leads to a sudden increase of the thread temperature (drawing energy, internal friction, release of internal tension). The energy released is rapidly removed through the liquid surrounding the filament if the thread temperature should reach temperatures above the bath temperature (second order transition point), this is shown in FIG. 2 by the line $T_5$. In case that the drawing starts when the thread has not yet reached the bath temperature, the released energy will heat up the thread to the desired temperature, so that the thread is mostly drawn at the desired temperature, a case shown in FIG. 2 by the line $T_3$. Due to the small thermal source of the thread and the large thermal sink of the liquid, the drawing process can be carried through approximately isothermal. Advantageously, the mass flow of the bath liquid (compared with the mass flow of the thread material) is adjusted in such a way, that isothermal drawing is possible.

At the drawing point, the thread tension ($P_f$) also increases suddenly ($P_{f3}$) as the filament must be accelerated to the higher speed. The increased thread speed, after drawing, causes an even steeper increase in the thread tension ($P_{f4}$), although the fibrils after drawing are thinner ($F_s$) and therefore the friction area between filaments and liquid has become smaller.

The steeper the curves (functions) for the drawing tension $P_s$ and the thread tension $P_f$ intersect with each other and the nearer this intersection point lies to the temperature of the second order transition point, the more accurately the drawing point is fixed. There is scarcely any local displacement and the point will not expand to a randomly extended zone. A drawing operation which is controlled in this way, leads to high uniformity, high strength and careful thread treatment at optimal temperatures.

The entire process is shown here on a single filament. However, it is naturally decisive that the 30 or 50 filaments of a yarn are simultaneously exposed to the same physical conditions as the single filament mentioned. For this purpose, the device for carrying out the drawing is so equipped, that the yarn is lead through the device in the form of a ribbon, in which the fibrils are positioned side by side.

The drawing process comprises the steps of warming the individual filaments of the thread in a substantially closed chamber by means of a fluid heating medium in a substantially uniform manner towards the second order transition temperature while at the same time increasing the thread tension by means of hydrodynamic braking. The thread tension is increased until it reaches the drawing tension required for the drawing of the yarn when the yarn has reached the second order transition temperature (or when the yarn can reach that temperature due to heat generated in the course of the drawing operation). Since, however, the second order transition temperature and the drawing tension differ between different yarns or threads, it is desirable to develop, in parallel with this drawing process, additional features which permit a corresponding adjustment of other process parameters, in particular the temperature and the braking effect in the drawing arrangement. This is also desirable as regards fine adjustment for optimizing the drawing process and for automatic or manual control of the process.

FIG. 2 shows an embodiment of a fluid drawing arrangement, which corresponds in its essentials with the arrangements of the abovementioned European application 90810061.3. However, this embodiment is provided with additional means for setting of the processing parameters so that the method and the device can be adapted to various yarn qualities (characteristics) and various yarn processing speeds.

Method and device according to the invention thus provide the following advantages, given in short words:

As the filaments in case of a yarn consisting of more than one filament are lead through the drawing bath in the form of a ribbon, the wetting of the filaments with the bath liquid is uniform and therefore the braking and the heating of the filaments are uniform also.

As at the entrance to the chamber, air carried by the thread, and with it a non-controllable insulation, is removed from the thread, the heating of the thread is controllable.

As the bath liquid has a high heat capacity and is circulated, heat is transferred quickly between thread and liquid. This makes conditions ideal for isothermal drawing. If the filament is the heat source (in the case of overheating), then the bath is a very large sink for absorbing the energy. If the filament is the heat sink (on heating), then the bath is a very large source for delivering the necessary energy. Therefore, the energy flow is always high in the correct direction in order to obtain high dynamics in the heat control.

As the effective length of the drawing bath, over which the thread is subjected to the braking fluid, can be varied, the braking effect can be set and regulated.

As the circulation of the braking fluid and the geometry of the chamber are adaptable, the flow conditions in the chamber, and thus the hydrodynamic braking effect upon the thread, can be adjusted.

As adjustable means are provided for mechanical thread braking, the braking effect can be varied by means of a combination of hydrodynamic and mechanical braking.

In a case in which the thread F consists of more than one filament, it is advantageous to cause the thread to pass through the fluid in the form of a ribbon in which the individual filaments are arranged as near as possible next to each other (in a plane normal to the plane of paper in FIG. 2). The braking fluid can be provided in a main chamber 1 which is closed except for a narrow slot-shaped entry opening 11 and an equally narrow, slot-shaped exit opening 12 for the filament bundle. The braking fluid is pumped through this main chamber 1 in such manner that the fluid enters the main chamber through an entrance 2 and leaves by way of an exit 4. The main chamber 1 is divided by two walls 5.1 and 5.2 extending parallel to the threadline and dividing the chamber 1 into a thread passage 1.2 and two outer passages 1.1 and 1.3. These walls are movable while remaining parallel to the threadline in such manner that the thread passage can be made very narrow and the outer passage can be made correspondingly wide. The two outer passages contain settable throttling means 6.1 and 6.2 by means of which their throughflow section can be locally reduced.

Before entering the main chamber, the thread runs through an antechamber 7 which can be open at the face through which the thread enters. The same braking fluid is also pumped through this antechamber, namely through an entry port 8 in the antechamber and through an exit port 9. The exit port 9 is provided with means enabling the adjustment of the level of fluid 14 in the antechamber 7 e.g. by means of a movable curved tube section 10. A cylindrical diverting element 13 is arranged immediately before the entrance 11 into the main chamber. The main purpose of this diverting element 13 is to arrange the filament bundle entering the main chamber 1 in such a manner that the individual filaments are arranged as close as possible next to each other in the form of a filament ribbon as they pass through the main chamber 1. Two further diverting elements 15.1 and 15.2 (which can also be cylindrical) are arranged immediately below the braking liquid level 14 and are movable therewith. The main task of these additional diverting elements is to press out air which may be carried along with the thread so that such air is not dragged into the chambers of the drawing device.

An arrangement as schematically illustrated in FIG. 2 enables the two most important parameters of the drawing process (namely, the temperature of the braking fluid and its braking effect) to be adapted to the operating circumstances and to be adjusted within a wide range.

The adjustment and regulation of the temperature of the braking fluid is achieved e.g. by means of a corresponding thermostatically controlled reservoir for the braking fluid (not illustrated in FIG. 2) from which the braking fluid is pumped into the two chambers 1, 7.

The hydrodynamic braking effect exerted by the braking fluid on the thread depends primarily on the length of the threadline within (exposed to) the braking fluid, upon the viscosity of the braking fluid, on the flow conditions within the chambers 1, 7 and on the linear speed of the thread. The length of threadline within the fluid is adjusted and regulated by setting and regulating the level 14 of fluid in the antechamber 7. Main chambers of various lengths could also be used. The viscosity of the fluid is adjusted by corresponding selection of the braking fluid. The flow conditions in the main chamber 1 are adjusted and regulated by adjusting and regulating the direction of flow, the quantity rate of supply of braking fluid and the speed of flow of the braking fluid, and also by adjustment of the position of the walls 5.1 and 5.2, of the throttles 6.1 and 6.2 and by the use of walls 5.1 and 5.2 with varying surfaces directed towards the thread.

The flow conditions in the main chamber 1 are determined primarily by the direction and rate of circulation of the braking fluid. In the example according to FIG. 2, the braking fluid flows e.g. upwards, that is against the direction of movement of the thread. However, the thread drags fluid along, especially when the thread is moving at a high linear speed, so that in the thread passage 1.2 a flow of fluid arises in the direction of movement of the thread. Accordingly, a circulation component directed downwards in the thread passage 1.2 and upwards in the outer passage 1.1 and 1.3 is superimposed upon the basic circulation flow which, as previously mentioned, is directed upwards from the lower to the upper end of the device. The throttling elements 6.1 and 6.2 in the outer passages 1.1 and 1.3 therefore exert two different throttling effects. The first effect lies in throttling of the basic circulation flow with a consequent increase in the pressure in the portion of the chamber lying upstream of the throttle position. The second throttling effect lies in throttling of the circulation component directly generated by the thread with a corresponding influence upon the braking effect exerted by the fluid upon the thread. A strong throttling effect at the throttling elements 6.1 and 6.2 increases the braking effect without the danger of an increase in turbulence disturbance in the thread passage. The adjustable width of the thread passage 1.2, enabled by the adjustability of the walls 5.1 and 5.2 can also act as a throttle for the circulation components associated with the thread and can thus exert an influence upon the braking effect especially when the width of thread passage is made very small. Also, when the thread passage 1.2 is made very narrow, the characteristics of the surface of the walls 5.1, 5.2 directed towards the thread can exert an influence on the braking effect because the generation of flow vortices in the thread passage 1.2 is dependent, amongst other things, upon these surface characteristics.

The variation of the braking effect by variation of the spacing between the thread and the passage walls is based upon the fact that the flow through a hollow body is not, in the neighborhood of the internal wall of that body, dependent solely upon the pressure difference and the flowing medium, as is the case at positions sufficiently spaced from the internal wall. In layers which are located very close to the internal wall, the friction of the medium on the wall itself influences the flow conditions which in turn are dependent upon parameters such as, e.g., the surface characteristics of the wall. The outermost layer of the flowing medium will, in any event, have a very low speed of flow compared with the inner regions. If the speed differential between the inner and outer regions is large, then flow discontinuities can also occur in intermediate regions leading to local turbulence and thus also to speed components at right angles to the general direction of flow. Such effects then cause local highly increased hydrodynamic resistance. A thread moving with or against the direction of flow in a chamber in accordance with the invention will be subjected to this increased resistance. The hydrodynamic braking effect will therefore depend upon the spacing of the thread from the chamber wall, or other solid surface relative to which the thread is guided, and also upon the characteristics of its surface. Practice has shown that such effects exert an influence upon the braking effect of the braking fluid with spacings between the thread and the wall in the region of 0.05 to 1.00 millimeters. Variations in the surface characteristics can be obtained, e.g. by fine polishing (Ra 0.05 umm), coarsely machining, profiling or sandcoating (Ra 45 umm) the corresponding surfaces.

The braking effect in the arrangement can also be varied by providing additional mechanical braking in the diverting elements 13, 15.1 and 15.2. Such mechanical braking in the region of the antechamber 7 results in an increased thread tension at the entrance to the main chamber 1. The diverting elements can be made adjustable parallel to their axes to provide setting possibilities such that the respective diverting angle can be set and regulated. Since the diverting elements are located within the braking fluid, wetting thereof by the braking fluid is ensured, so that increases in friction on these elements due to running dry, which would be prejudicial to the thread, are excluded.

FIG. 2 represents an embodiment of a device for hydrodynamic drawing of a polymer thread wherein the advantages of this variant arise from the division of the length of threadline subjected to the braking fluid into an antechamber 7 and a main chamber 1. This enables an increased pressure in the main chamber 1 with simultaneous continuously adjustable length of thread subjected to the braking fluid and this pressure increase, in turn, minimizes any dragging along of air by the threadline while increasing the range of selectable possibilities for the braking fluid (boiling point). However, the device can only be operated in the illustrated position, that is with a threadline extending vertically. No leakage problems arise at the entry opening 11.

In the following, further modifications and special advantages will be mentioned briefly.

The antechamber can be eliminated, in which case the use of the device is no longer limited to a vertically oriented threadline. The length of threadline subjected to the braking fluid is, however, then only adjustable by using drawing chambers of various lengths, and the adjustability is therefore no longer continuous. The entrance opening 11 must be designed in such a manner that leaking through this opening can be maintained at a minimum. A chamber of this type is preferably operated with overpressure so that the walls of the entry opening 11 are continuously wetted and thus any possible contact between these walls and the filaments does not give rise to high mechanical friction.

The division between an open antechamber and a quasi-closed main chamber can be eliminated. In this case, the device can only be operated in a vertical disposition and it is no longer possible to generate an overpressure in the drawing chamber.

The main drawing chamber can contain only a single adjustable wall 5 or the adjustable walls can be eliminated completely which simplifies manufacturing of the device.

The diverting elements immediately below the fluid surface in the antechamber can be eliminated in which case the air dragged along by the thread cannot be pressed out. This can lead to increased foaming of the braking fluid. In this case, mechanical braking is limited to a minimum which can prove to be advantage in processing of sensitive yarns.

The means for forming a ribbon can be eliminated giving a simplified device for processing of individual filaments.

Further small chambers can follow, considered in the direction of movement of the thread, after the exit opening 12. In these additional chambers, the fluid carried along from the drawing chamber by the thread can be thrown off and/or can be sucked away. A similar drying effect can be achieved if a fluid removal device is connected to an arrangement in accordance with FIG. 2 immediately following upon the drawing or main chamber considered in the direction of movement of the thread. A corresponding fluid removal device is described in Swiss Patent Application No. 1689/90 of May 18, 1990. The use of means for throwing off fluid dragged along by the thread permits the use of a braking fluid of higher viscosity by means of which a correspondingly increased braking effect can be achieved.

The device can be so arranged that it can be traversed by several threads running parallel to each other. The chambers then have to be made correspondingly broader and additional guide elements are preferably provided at the entrance to the main chamber to ensure separated threadlines for the individual filament bundles.

Figure 3A:
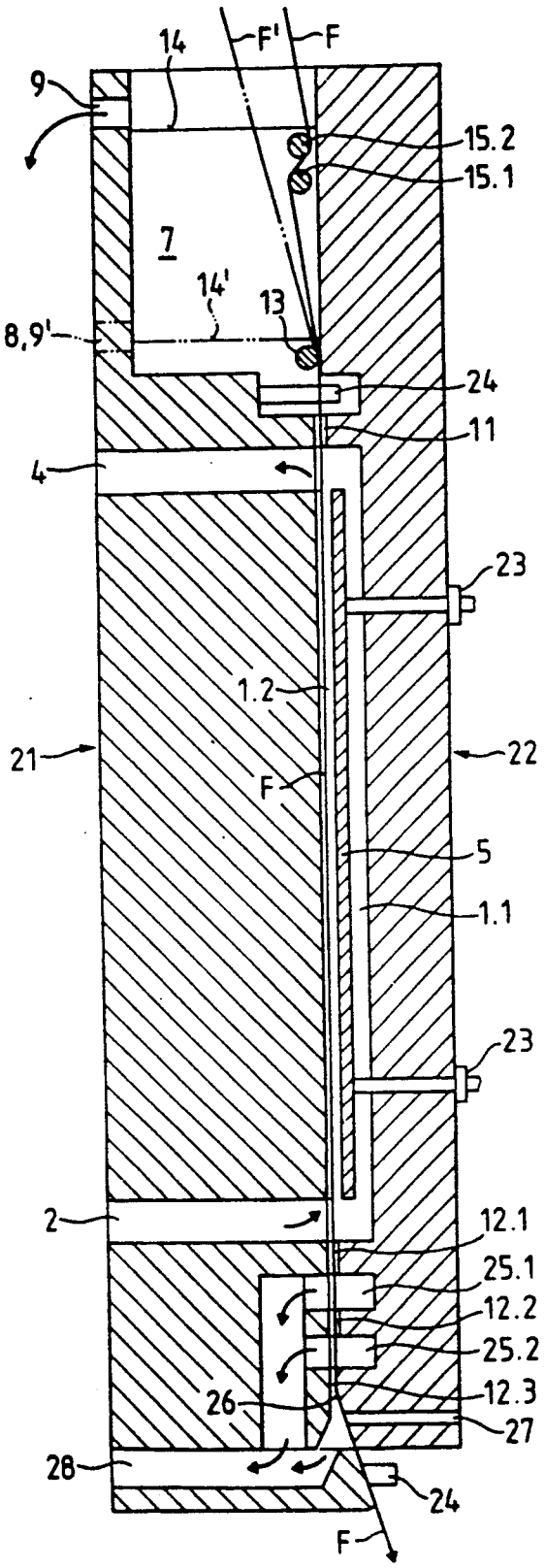
FIGS. 3 (*a* and *b*) show one embodiment of the drawing chamber according to the invention with a widened chamber for passage of two threads, as a section parallel to the threadline and as a plan view of the corresponding base portion.
Figure 3B:
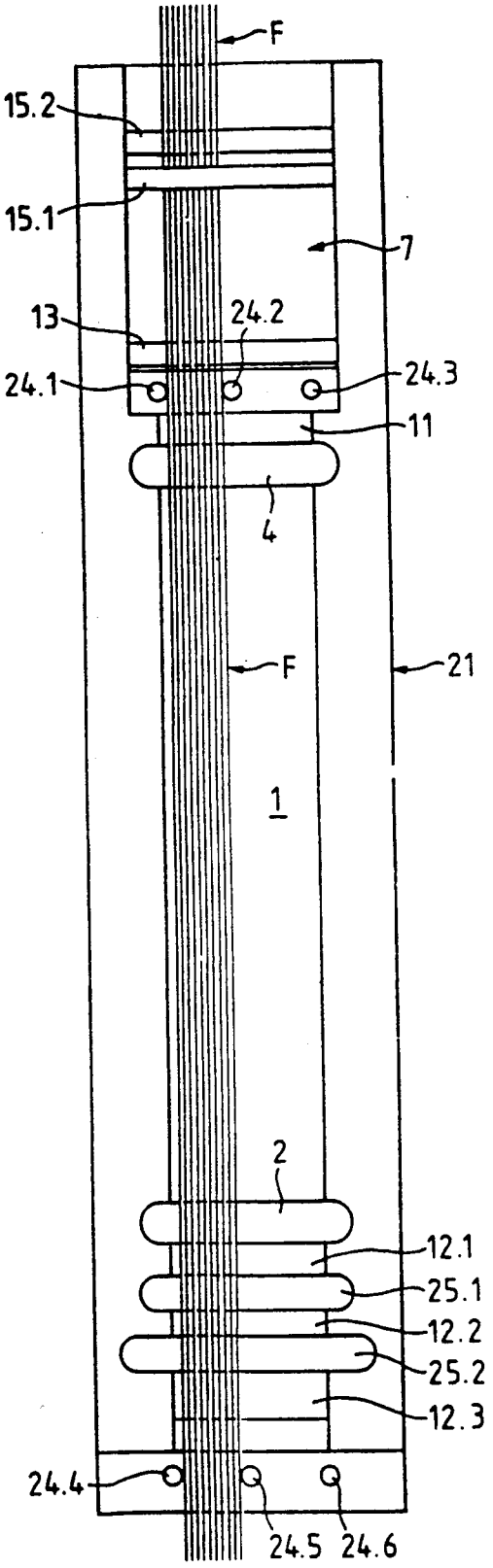

Referring to FIGS. 3*a* and 3*b* wherein like reference characters indicate like parts as above a modified device for hydrodynamic drawing of a polymer thread comprises a main chamber 1 and an antechamber 7 and is designed for processing of two parallel running threads (in FIG. 3*b*, only the left hand thread has been illustrated). Two possibilities are illustrated for the passage of the thread through the antechamber 7. One possibility (with a relatively high level of braking fluid) is shown in full lines and with reference numerals corresponding to those of FIG. 2 while the other (with the relatively low fluid level) is illustrated in dotted lines and the elements are designated by reference numerals provided with a dash.

The device preferably comprises two portions, a base portion 21 and a cover portion 22 which can be swung apart to enable laying of the thread or threads to be processed into the device. The separation plane of the portions is preferably the plane in which the thread or threads move through the device. The base portion 21 can, e.g., be fixedly arranged and carries infeed and exhaust connections for the braking fluid, and the like.

The thread F, which can comprise an individual filament or a bundle of filaments, runs as already described with reference to FIG. 2 through the antechamber 7 through which the braking fluid is also flowing (infeed duct 8, exhaust duct 9). The thread F is guided over at least one diverting element, e.g. over two cylindrical ceramic pins 15.1 and 15.2, which are arranged immediately below the fluid surface 14. Air dragged along by the filaments is squeezed out on these diverting elements so that the generation of foam is limited to this region of the arrangement and a prejudicial effect upon the drawing process (due to the presence of an uncontrolled insulating layer between the filaments and the braking fluid) is avoided. In dependence upon the angle of wrap on the two diverting elements 15.1 and 15.2, the thread is subjected to a greater or lesser degree of mechanical braking such that (for example) the thread tension at the entrance to the main chamber 1 can be adjusted. Hence, these diverting elements 15.1, 15.2 act as an adjustable means for adjusting the braking of the thread. Immediately before the entrance into the main chamber 1, each thread is reshaped by the diverting element 13 e.g. in the form of a cylindrical ceramic pin, to a ribbon shape and the threads are separated by guiding elements 24.1, 24.2 and 24.3 and are restricted in their width. Corresponding guide elements 24.4, 24.5 and 24.6 are also provided at the thread exit from the device.

Figure 5:
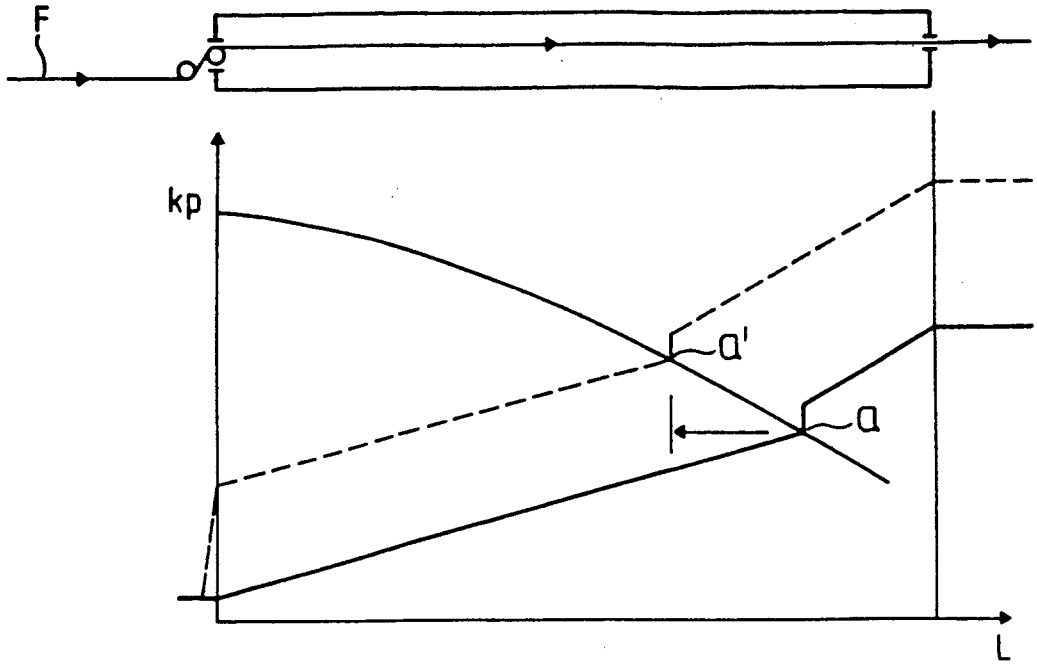
FIG. 5 shows graphically the combination of the hydrodynamic braking process with mechanical braking.

Mechanical braking of the threads before the entrance into the main chamber at the diverting elements 15.1 and 15.2 increases the tensile stress exerted on the filaments in the main chambers so that they reach the level of the drawing tension more quickly, that is, after passing through a shorter path section within the braking fluid. The effect of such "pre-braking" is illustrated in FIG. 5. Supposing that without mechanical pre-braking the drawing point is located at a, pre-braking moves the drawing point, it towards the chamber entrance, e.g. to the location al. By means of this pre-braking, it is possible, e.g. to use a drawing arrangement which has been designed for use with a very high thread speed (and which is correspondingly short) for processing of threads with lower linear speeds. In the latter case, the braking effect of the fluid is considerably less so that the path length over which the thread is subjected to the braking fluid would not suffice to give an adequate braking effect without pre-braking. However, the braking effect of the "mechanical contribution" cannot be allowed to reach a level such that the drawing effect which is to be achieved occurs at the pins because at that point in the process, the thread has not reached the ideal drawing temperature which corresponds approximately to the chamber temperature.

The same device can be used without pre-braking (with a reduced effective length over which the thread is subjected to the braking fluid) if the infeed 8 for the braking fluid in the antechamber 7 is switched over to function as an outfeed. Braking fluid leaking through the entrance opening 11 from the main chamber 1 then collects in the antechamber 7 and rises to a level 14' such that the diverting element 13 is still covered with fluid. The threads F' are in this case not guided over the diverting elements 15.1 and 15.2 but directly on the diverting element 13.

A very narrow opening (slot) 11 is provided for the entry of the threads into the main chamber 1, and is preferably provided in the form of a recess in the base portion 21 alone. A collecting tank 4 is provided at a spacing from the entrance slot 11 and braking fluid forced in counter flow runs off via this tank. The tank 4 is formed, as in the case of the main chamber 1, in both body portions, base portion 21 and cover portion 22. An empty tank 2 is arranged near the thread exit from the main chamber 1 and is formed in the same manner as the collecting tank 4. Both tanks 2 and 4 are allocated their function in dependence upon the direction of flow since the main chamber can be operated in a counter flow or in a codirectional flow mode. The actual drawing chamber is located between these two tanks and the threads run in the separation plane between the base and cover portions. An adjustable wall 5 is provided in the main chamber 1 and extends parallel to the threads while being adjustable by means of adjusting means 23, e.g. in a form of adjusting screws. The wall 5 divides the main chamber 1 into a thread passage 1.2 and an outer passage 1.1. Starting from a predetermined, minimum distance which must be maintained between the thread and the wall 5, the adjustment of the wall relative to the thread path influences the braking and thus the drawing effect. The operational spacings can be determined, e.g. experimentally and used in the course of processing.

Short slot-shaped openings 12.1, 12.2, 12.3 are provided as thread exits and are separated from each other by additional tanks or traverse chambers 25.1 and 25.2 in such a manner that they form a kind of labyrinth in which braking fluid dragged along by the thread can flow off with or without vacuum assistance (pressure differential above normal pressure also possible). A withdrawal edge 26 follows immediately upon this labyrinth and is provided preferably with a small diverting radius on which the thread is diverted and squeezed out. An air exit nozzle 27 immediately below the withdrawal edge 26 supports the separation of braking fluid dragged along by the thread and a suction device 28 facing the nozzle 27 serves to carry away the spray generated at this point. In order to ensure separate guiding of the threads in the course of their passage through the drawing arrangement, guide elements 24.4, 24.5 and 24.6 are provided at the thread exit from the device as at the entrance to the main chamber 1.

The device illustrated in FIGS. 3*a* and 3*b* is obviously small and can be inserted into the threadline not only following the spinerette but also possibly at other locations in the processing operation.

Figure 4A:
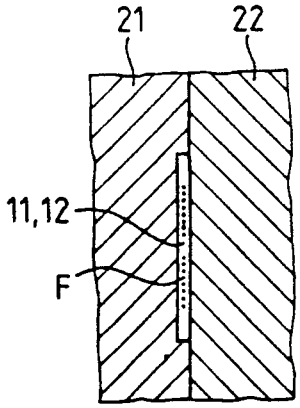
FIGS. 4 (*a* and *b*) show respective sections at right angles to the threadline at different positions of the chamber in accordance with FIG. 3.
Figure 4B:
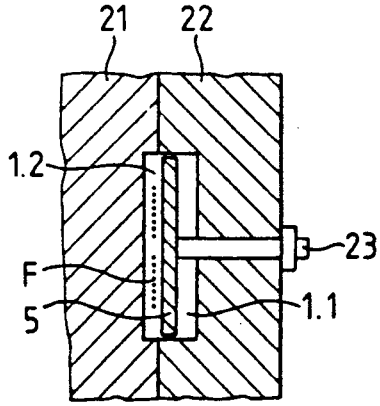

FIGS. 4*a* and 4*b* show the drawing arrangement in accordance with FIGS. 3*a* and 3*b* in traverse section at the level of the entrance opening 11 or exit opening 12 (FIG. 4*a*) and through the main chamber 1 (FIG. 4*b*). As already described, chamber-forming recesses are provided in the base portion 21 and correspond with chamber-forming recesses in the cover portion 22. Due to the adjustable wall, the section of the thread passage 1.2 on the one hand and the spacing between the filaments and the wall 5 on the other hand can be adjusted. This gives, e.g., the possibility to use differently shaped cover portions 22 with a single base portion 21, e.g. with and without the adjustable wall 5, and thus to vary the "chamber characteristics".

In the description of the embodiments, a "filament containing" plane is mentioned as a preferable order of the filaments in a thread to be drawn. Nevertheless, the filaments can be ordered in a more generalized surface, e.g. comprising a slight curvature. Where the "surface of order" is a plane, this can be generated by means of a cylindrical pin (e.g. pin 13 in FIG. 1); on the other hand, a curved surface of order might be generated by a corresponding "ordering means".

Threading up of the device can be carried out very simply and can be easily automated. For example, in order to effect a start-up, the liquid inflow and the blowing air can be interrupted and the chambers 1, 7 are emptied e.g by suction. The cover portion 22 is opened relative to the base portion 21 and the thread is positioned in the recesses of the base portion corresponding to the entry opening 11 and the exit opening 12 with a suction gun. The filaments of the thread form a ribbon automatically. Remaining crossings between filaments are eliminated as soon as the thread is moving. Thereafter, the cover portion 22 is positioned on the base portion 21 and fixed. Circulation of the liquid and the air are then started. The heating and breaking action begin in slow and controlled manner.

The thread extending from the drawing bath exit opening is laid on a following thread delivery mechanism such as a roll or winder with a suction gun. If the suction force of the gun is too low to draw through the thread, which is exerting resistance due to the braking force of the fluid bath, it may be necessary to place the thread on the following delivery means prior to the release of the chamber medium into the chamber. As soon as the thread is sufficiently entrained there, the chamber medium can be released and the process started.

Suction air can be advantageously applied continuously throughout the period of a threading up operation in order to take up any small leakages which may occur.

In the same way as illustrated in FIGS. 2 and 3, it is possible with an accordingly wider device to draw three or more parallel threads. In this way, more "channels" are provided with the same amount of "infra structure", such as pumps for the braking fluid and for the air.

In FIGS. 3 and 4, the chamber-forming recesses in the two portions 21 and 22 have been illustrated as rectangular in section. However, they do not have to take this shape. In the cover portion (as also in the case of the base portion), the chamber parts can be given an optimal shape from the point of view of fluid flow theory, and in dependence upon the braking fluid which is actually used in the individual case. The cover portion can be correspondingly adapted to the braking fluid.

The diverting elements 13, 15.1/2 and the guiding elements 24.1/2/3/4/5/6 used in the antechamber and in the main chamber are preferably ceramic pins. These may each be held in place by a set screw engaging in a screw threaded bore in the support body. The screw may have a resilient insert provided in a blind bore at its end engaging the pin. The insert may be in the form of a short nylom cylinder or rod which is squashed between the pin and the screw and thus exerts a clamping force on the pin without damaging the pin.

FIG. 6 represents a further embodiment in contrast to the variant described with the reference to FIG. 3. The embodiment in FIG. 6 comprises two adjustable walls 5.1 and 5.2. This modification is also characterized by diverting elements 61.1, 61.2, e.g. ceramic pins, which are mounted alternately on the one and the other of the surface of the walls 5.1 and 5.2 facing towards the threads. These diverting elements influence not only the flow characteristics in the thread passage 1.2, but also divert the thread and exert a braking effect dependent upon their mutual spacings. An arrangement of this kind brings the additional advantage, that, as in the case of very narrowly spaced walls, fluid tending to build a layer around each thread is peeled off without an associated risk of jamming the filaments. Furthermore, the diverting elements provide periodic supports for the threads at short intervals, which tends to prevent flapping of the filaments in the thread passage.

FIG. 7 is a diagrammatic illustration setting a device in the context of a complete threadline operating in accordance with a so-called spin-draw-winding process.

As shown, a delivery means in the form of a spinerette 30 is provided in the wall of a nonillustrated tank which contains a synthetic plastics material in the form of an extrudable fluid which can be pressed through jet openings (not individually indicated) in the spinerette 30 to form an individual filament of thread 31 in each jet opening. Eight such individual filaments are illustrated in FIG. 7 but this illustration is to be taken by way of example only. In practice, a much larger number of jet openings can be provided in the spinerette to form a corresponding number of filaments which are subsequently collected into a multifilament thread.

The jet openings in the spinerette 30 can be arranged in any desired pattern. For the sake of simplicity, it will be assumed that the openings in the spinerette 30 are all arranged at mutually equal spacings within an imaginary circle described around a center lying approximately on the longitudinal axis of the resulting bundle of filaments.

After leaving the spinerette 30, the thread is passed to a hydrodynamic drawing device 32 which can be formed in accordance with any one of FIGS. 2 or 3 already described above. The bundle of collected filaments leaving the device 32 is passed to a means for generating a tensile force on the synthetic threads, i.e. filaments, such as a draw roll 34 and is wound several times around the draw roll 34 and an associated separator roll 36 before being passed to a take-up system (not illustrated in detail) in which the thread is wound, for example into a cylindrical package 38. The draw roll may be formed in accordance with European patent No. 0349829 and the take-up system may comprise a winder e.g. in accordance with European patent application No. 0367253.

The draw roll 34 is driven about its own main axis which extends at right angles to the plane of the drawing shown in FIG. 7. Wrapping of the thread around the draw roll 34 and separator roll 36 "binds" the thread to the draw roll so that as the latter rotates it applies a tensile force to the thread pulling the thread away from the spinerette 30 and hence through the draw bath 32.

The rate $v_1$ at which synthetic plastics material is pumped through the jet openings in spinerette 30 and the linear speed $v_3$ of delivery of the thread between the draw bath 32 and the draw roll 34 together determine the titer of each individual filament. The take-up system 38 is arranged to take-up the thread at the same speed $v_3$ with which the thread is delivered to the draw roll 34. The overall draw ratio $v_3:v_1$ is now divided into the spinning draw ratio $v_2:v_1$ (effective in a region in which the synthetic material is in a plastic condition) and the "hydraulic" draw ratio $v_3:v_2$ where $v_2$ is the linear speed of each filament at the point of entry to the draw bath 32.

What is claimed is:

1. A process for hydrodynamic drawing of a polymer thread, said process comprising the steps of
   forming a bath of heated liquid;
   moving a polymer thread under tension through said bath in heat exchange relation therewith;
   heating the thread in said bath to a temperature of the second order transition point of the thread; and
   braking the thread in said bath by means of the braking force between the thread and the liquid to increase the tension in the thread to a drawing tension sufficient to effect drawing of the thread while in said bath.

2. A process as set forth in claim 1 wherein the liquid in said bath flows in one of a concurrent and countercurrent direction relative to the thread and is maintained at a temperature in the region of said second order transition point of the thread.

3. A process as set forth in claim 2 which further comprises the step of adjusting the braking of the thread in said bath in dependence on the thread characteristics.

4. A process as set forth in claim 3 wherein the length of thread in said bath is varied to adjust the braking of the thread.

5. A process as set forth in claim 3 wherein at least one of the direction of flow, quantity rate of flow and speed of flow of the liquid in said bath is variable to adjust the braking of the thread.

6. A process as set forth in claim 3 wherein vortices are generated in the flow of liquid to adjust the braking of the thread.

7. A process as set forth in claim 1 wherein a plurality of said threads are moved through said bath in parallel ribbon-like manner.

8. A process as set forth in claim 1 wherein said bath is pressurized and the liquid in said bath is at a temperature above the boiling point of the liquid.

9. A process as set forth in claim 2 wherein the mass flow of the liquid in said bath is sufficient to maintain isothermal temperature conditions therein.

10. A process as set forth in claim 1 which further comprises the steps of superimposing a mechanical raking effect on the moving thread in said bath.

11. A process for hydrodynamic drawing of a polymer thread, said process comprising the steps of
   moving a polymer thread through a predetermined channel-like path;
   tensioning the thread in said path;
   forming a bath of heated liquid in said path in heat exchange relation with the tensioned thread to heat the thread to a temperature of the second order transition point of the thread; and
   braking the thread in said path by means of the braking force between the thread and the liquid to increase the tension in the thread to a drawing tension sufficient to effect drawing of the thread while within the liquid.

12. A device for hydrodynamic drawing of a polymer thread, said device comprising
   a delivery means for delivering at least one polymer thread;
   means for generating a tensile force in the thread;

a drawing means between said delivery means and said means for generating a tensile force, said drawing means including a base portion and a cover portion defining a chamber therebetween for passage of the thread therethrough on a predetermined path and for receiving a bath of liquid therein for braking of the thread passing therethrough; and adjustable means for adjusting the braking of the thread passing through said chamber.

13. A device as set forth in claim 12 wherein said drawing means includes a diverting element for forming a thread having a plurality of filaments into a ribbon of filaments.

14. A device as set forth in claim 12 wherein said drawing means includes at least one separating wall in said chamber parallel to said thread path to divide said chamber into a thread passage and at least one outer passage and said adjusting means is connected to said wall to move said wall relative to said thread path to adjust the spacing therebetween.

15. A device as set forth in claim 14 which further comprises a plurality of diverting elements on said wall facing said thread path to divert a thread passing thereover.

16. A device as set forth in claim 14 which further comprises a throttle in said outer passage for throttling a flow of fluid passing therethrough.

17. A device as set forth in claim 12 wherein said drawing means includes an antechamber between said portions for passage of a thread therethrough prior to passage into said main chamber.

18. A device as set forth in claim 17 wherein said drawing means includes a plurality of guiding elements in said antechamber for ordering a plurality of filaments of a multifilament thread into a ribbon and an exhaust duct communicating with said antechamber to exhaust liquid therefrom, said duct being disposed above said guiding elements to permit immersion of said guiding elements in the liquid.

19. A device as set forth in claim 17 which further comprises an infeed duct to said antechamber, an exhaust duct to said antechamber and means for circulating a braking medium through said ducts and said antechamber.

20. A device as set forth in claim 17 which further comprises means for adjusting the level of braking liquid in said antechamber.

21. A device as set forth in claim 12 which further comprises means for regulating the pressure and temperature of the liquid in said main chamber.

* * * * *

UNITED STATES PATENT AND TRADEMARK OFFICE

CERTIFICATE OF CORRECTION

PATENT NO. : 5,307,547

DATED : May 3, 1994

INVENTOR(S) : FELIX GRAF

It is certified that error appears in the above-identified patent and that said Letters Patent is hereby corrected as shown below:

Column 14, lines 48 to 49 "raking" should be -braking-

Signed and Sealed this

Ninth Day of August, 1994

*Attest:*

Bruce Lehman

BRUCE LEHMAN

*Attesting Officer*

*Commissioner of Patents and Trademarks*